United States Patent [19]

Nabulon et al.

[11] Patent Number: 4,782,566

[45] Date of Patent: Nov. 8, 1988

[54] METHOD OF TEXTURIZING CONTINUOUS FILAMENT THREADS

[75] Inventors: Werner Nabulon, Ruedlingen; Peter Grossenbacher, Winterthur, both of Switzerland

[73] Assignee: Maschinenfabrik Rieter AG, Winterthur, Switzerland

[21] Appl. No.: 79,831

[22] Filed: Jul. 30, 1987

Related U.S. Application Data

[63] Continuation of Ser. No. 877,432, Jun. 23, 1986.

[30] Foreign Application Priority Data

Jul. 15, 1985 [CH] Switzerland ..... 03059/85

[51] Int. Cl.[4] ..... D02G 1/12; D02G 1/16

[52] U.S. Cl. ..... 28/255

[58] Field of Search ..... 28/255, 264, 267, 271

[56] References Cited

U.S. PATENT DOCUMENTS

| | | | |
|---|---|---|---|
| 3,669,328 | 6/1972 | Castelli | 28/255 X |
| 3,729,831 | 5/1973 | Kosaka et al. | 28/255 X |
| 3,778,872 | 12/1973 | Newton | 28/255 |
| 3,802,038 | 4/1974 | Bauch et al. . | |
| 3,802,039 | 4/1974 | Bauch . | |
| 3,849,844 | 11/1974 | Bauch et al. . | |
| 3,852,857 | 12/1974 | Ethridge et al. | 28/255 |
| 3,982,310 | 4/1974 | Beck et al. . | |
| 3,994,052 | 11/1976 | Fernandez | 28/255 |
| 4,014,084 | 3/1977 | Bauer et al. | 28/255 |
| 4,148,179 | 4/1979 | Becker et al. | 28/255 X |
| 4,188,691 | 2/1980 | Matsumoto et al. | 28/255 |
| 4,245,378 | 1/1981 | Price | 28/271 |

FOREIGN PATENT DOCUMENTS

| | | | |
|---|---|---|---|
| 2253857 | 7/1975 | France . | |
| 2304699 | 10/1976 | France . | |
| 58-70723 | 4/1983 | Japan | 28/255 |
| 527931 | 10/1972 | Switzerland . | |

*Primary Examiner*—Robert R. Mackey

*Attorney, Agent, or Firm*—Michael J. Striker

[57] ABSTRACT

An arrangement for texturizing continuous filament threads using a heated flowing medium comprises a housing which includes a feeding portion, a treatment portion and a crimping portion. The crimping portion includes a stuffing chamber in which the threads are longitudinally compressed to produce crimping of such threads. The crimping portion has openings through which the medium fed into the stuffing chamber with the threads can escape from the stuffing chamber. The crimping portion accommodates a plurality of lamellae which are arranged in a star-like configuration and jointly bound the stuffing chamber. A jet introduces a gas stream into the stuffing chamber in a direction which differs from the direction of advancement of the threads through the stuffing chamber, the gas stream penetrating between the lamellae into the stuffing chamber. At the commencement of the crimping operation, this gas stream causes initial retardation of the continuous thread passing through the stuffing chamber. This action of the gas stream can be continued even during the normal operation of the crimping arrangement.

3 Claims, 1 Drawing Sheet

METHOD OF TEXTURIZING CONTINUOUS FILAMENT THREADS

This is a continuation of application Ser. No. 877,432, filed June 23, 1986, now abandoned.

BACKGROUND OF THE INVENTION

The present invention relates to arrangements for treating fibers in general, and more particularly to arrangements for texturizing continuous filament threads by means of a heated flowing medium.

There are already known various constructions of texturizing arrangements of the above type. So, for instance, the Swiss patent specification No. 527 931 discloses an arrangement for texturizing continuous filament threads by means of a heated flowing medium, which arrangement is equipped with a so-called crimping portion which includes a stuffing chamber and in which the threads are longitudinally compressed to produce crimping of the threads. The crimping portion is provided with openings through which the medium that is fed into the stuffing chamber with the threads can escape from the stuffing chamber. In this known arrangement, the crimping portion is formed by lamellae which are arranged in a star-shaped configuration. The lamellae are fixedly mounted with a narrow side facing into the stuffing chamber for the thread. These lamellae are securely held at both of their ends by respective rings and, in this manner, they are held at predetermined spacings, so that the medium which is required for the performance of the texturizing operation can escape between the lamellae. Another texturizing arrangement of this type is described and illustrated in the Swiss patent application No. 2656/84-6.

Experience gained during the use of the texturizing arrangements or nozzles of the above type has shown that the retardation and attendant accumulation of the continuous filament thread in the stuffing chamber of the crimping portion of the texturizing arrangement, which is needed for imparting the crimp to the filament thread, cannot be accomplished under all circumstances, especially at the commencement of the operation of the texturizing arrangement, without employing some auxiliary means or measures. The result is that the continuous filament threads leave the texturizing arrangement uncrimped.

In order to avoid this result and to assist the formation of the crimp in the continuous filament thread at the commencement of the operation of the texturizing arrangement, it has been proposed and attempted to close the exit opening of the texturizing arrangement, that is, the opening through which the continuous filament thread leaves the interior of the texturizing arrangement, for a short period of time so as to provide for the initial retardation of the continuous filament threads in the stuffing chamber. However, it has been established that this procedure has a serious drawback, in that it is very difficult to determine the correct period of time for closing the exit opening of the texturizing arrangement. If the actual period of time for which the exit opening is closed is too short, proper retardation of the threads is not achieved. On the other hand, if the actual period of time for which the exit opening is closed is too long, the stuffing chamber can become blocked by the thread accumulating therein.

Another way which has been proposed for assisting this retardation effect involved blowing an air stream into the stuffing chamber in a direction substantially opposite to the direction of advancement of the continuous filament threads through the interior of the texturizing arrangement. In addition to disadvantages which are akin to those discussed above, such a method also has the drawback that the continuous filament threads can become lodged between the lamellae, and this can lead to undesirable disturbances and operation interruptions.

SUMMARY OF THE INVENTION

Accordingly, it is a general object of the present invention to avoid the disadvantages of the prior art.

More particularly, it is an object of the present invention to provide a texturizing arrangement which does not possess the disadvantages of the known arrangements of this kind.

Still another object of the present invention is so to design the arrangement of the type here under consideration as to be capable of carrying out the retardation of the continuous filament threads in a manner which is free of problems.

It is yet another object of the present invention to develop a texturizing arrangement of the above type in which adherence to any specific time period is not critical.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in an arrangement for texturizing continuous filament threads by means of a heated flowing medium, this arrangement comprising a housing including a crimping portion which includes a stuffing chamber in which the threads are longitudinally compressed to produce crimping of such threads and which has openings through which the medium fed into the stuffing chamber with the threads can escape from the stuffing chamber; and means for introducing a gas stream into the stuffing chamber in a direction differing from the direction of advancement of the threads through the stuffing chamber. A particular advantage of the arrangement of the present invention as described so far is that it renders it possible to achieve the retardation of the threads during their passage through the stuffing chamber in an extremely simple manner and with absolute reliability, and that the gas stream does not disturb the crimping operation after the establishment thereof.

It is especially advantageous when the direction of the gas stream encloses an obtuse angle with the advancement direction of the threads, as considered in such advancement direction.

According to another feature of the present invention, the crimping portion includes a plurality of lamellae extending in the advancement direction and arranged in a radiating pattern to jointly bound the stuffing chamber. Then, the introducing means blows the gas stream between the lamellae, particularly by aiming the gas stream between two of the lamellae. It is also advantageous when the introducing means includes a valve operative for selectively switching the gas stream on and off.

The present invention is also directed to a method of operating an arrangement for texturizing continuous filament threads by means of a heated flowing medium, which method comprises the steps of feeding the threads to be crimped, together with the medium, into a stuffing chamber of a crimping portion of a housing for the threads to be longitudinally compressed therein to produce crimping of such threads and for the medium to escape from the stuffing chamber through openings provided in the crimping portion; and introducing a gas stream into the stuffing chamber in a direction differing from the direction of advancement of the threads through the stuffing chamber. Advantageously, the introducing step includes activating the gas stream only for a brief period of time at the commencement of the crimping operation for retarding the threads in the stuffing chamber. However, it is also advantageous when the introducing step includes activating the gas stream at the commencement of the crimping operation and continuing the gas stream for the entire duration of the crimping operation for continuously retarding the threads in the stuffing chamber.

The novel features which are considered as characteristic of the invention are set forth in particular in the appended claims. The improved texturizing arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figures 1, 2:
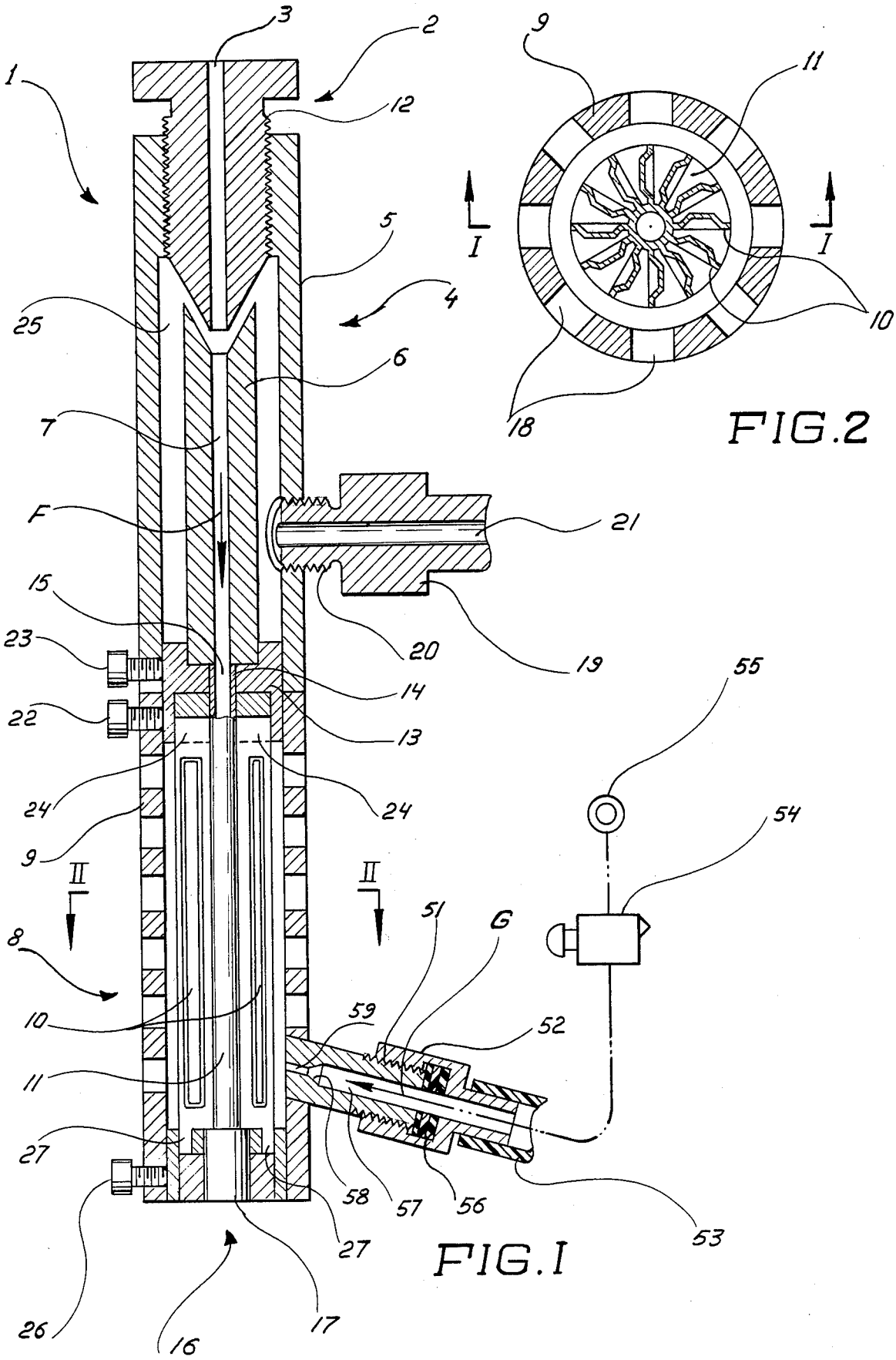
FIG. 1 is a partly diagrammatic longitudinal sectional view of a texturizing arrangement constructed in accordance with the present invention, taken on line I—I of FIG. 2.
FIG. 2 is an also partly diagrammatic cross-sectional view of the texturizing arrangement of the present invention, taken on line II—II of FIG. 1.

Referring now to the drawing in detail, and first to FIG. 1 thereof, it may be seen that the reference numeral 1 has been used therein to identify a texturizing arrangement constructed in accordance with the present invention. The texturizing arrangement 1 includes a thread feeding portion 2 having a thread feeding passage 3, and a treating portion 4 including an external tube 5 and a internal tube 6 located in the external tube 5 and bounding a treatment chamber 7. The texturizing arrangement 1 also comprises a crimping portion 8 adjoining the treating portion 4 downstream thereof as considered in the direction of advancement of a continuous thread through the texturizing arrangement 1 and including a perforated tube 9 provided in its interior with lamellae 10 which externally surround and define a stuffing chamber 11.

The thread feeding portion 2 is connected by means of a screw-thread 12 with the external tube 5, while the external tube 5 and the perforated tube 9 are centered by an internal connecting element 13 and can be secured together by means of screws 22 and 23, respectively. The connecting element 13 also serves, on the one hand, securely to receive the internal tube 6 and, on the other hand, to receive upper ends 24 (as viewed in FIG. 1) of the lamellae 10, which can be pushed into the connecting element 13.

A connecting tube 14 is received in the connecting element 13 and has a connecting bore 15 which connects the treatment chamber 7 with the stuffing chamber 11.

A discharge portion 16 of the texturizing arrangement 1, which adjoins the crimping portion 8, has a discharge bore or exit opening 17 through which the crimped thread (not shown) leaves the texturizing arrangement 1, together with a portion of the treatment medium. Another portion of the treatment medium, which escapes between the lamellae 10, passes through exit bores 18 of the perforated tube 9. A connector 19 which is secured by means of a screw-thread 20 in the external tube 5 serves to feed the treatment medium into the interior of the texturizing arrangement 1.

More particularly, the treatment medium is forwarded via a guide passage 21 provided in the connector 19 into a ring-shaped space 25 located between the outer tube 5 and the inner tube 6, and passes from this annular space 25 into the treatment chamber 7.

A lower extremity 27 of each of the lamellae 10, as viewed in a fiber advancement direction F, is received in the discharge portion 16 which bounds the exit opening 17. The discharge portion 16 is secured to the remainder of the texturizing arrangement 1 by means of a fixing screw 26 which is received in the perforated tube 9.

Furthermore, the perforated tube 9 has a nozzle portion 50 secured thereto. This nozzle portion 50 is provided at its end remote from the perforated tube 9 with a screw-thread 51 to receive a tube connecting portion 52. The tube connecting portion 52 serves, in turn, to receive a pressure tube 53 which is connected with a switching valve 54. The switching valve 54 is connected to a source of pressure 55.

A seal 56 is provided in the interior of the tube connecting portion 52 in order to avoid escape of leakage gas. The nozzle portion 50 has a pressure gas feeding bore 57, a nozzle cone 58 and an injection jet 59.

A feed direction G for the gas injected through the nozzle portion 50 forms an obtuse angle with the advancement direction F for the endless filament threads, as viewed in this advancement direction F. In other words, in the illustrated construction, the gas blown into the stuffing chamber 11 through the jet 59 also has a force component in the direction opposed to the advancement direction F. However, this is merely a currently preferred embodiment, since it has been established that this angle can also be formed as a right angle or as an acute angle without disadvantage.

Furthermore, the pressure of the gas delivered by the pressure source 55 is already reduced to a predetermined level which is determined by tests or experiments, so that the effect of this gas stream causes no disturbances in operation and also causes no disadvantageous effects on the filament.

It was also established that the gas stream can be aimed either directly between two lamellae 10 or against one of the lamellae 10, without an significant difference having been noted in the retardation effect. As a further variant, the gas can be blown in continuously even after the initial retardation has been achieved, without any disturbance to the texturizing effect being noted.

In normal operation, after the endless filament bundle has been introduced into the interior of the texturizing arrangement 1, to leave such interior again via the exit opening 17 in the advancement direction F, a gas stream is blown into the stuffing chamber 11 at least for a brief moment by means of the switching valve 54. This causes damming-up of the filament bundle, which effect ordinarily continues in further operation even without this gas stream. As already mentioned, however, no undesirable effects arise during the texturization if the gas is blown into the stuffing chamber 11 even after the initiation of the texturizing operation. Thus, where the damming-up effect is unstable, there is the possibility of basically avoiding interruptions in the damming-up effect with the aid of a continuously injected gas stream. It is clear that in such a case the switching valve 54 must be correspondingly settable. Normally prepared, oil-free air can be used as the gas injected in the form of the gas stream.

It will be understood that each of the elements described above, or two or more together, may also find a useful application in other types of arrangements differing from the type described above.

While the invention has been illustrated and described as embodied in an arrangement for texturizing continuous filament threads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A method of operating a texturizing nozzle for texturizing continuous filament threads by means of a heated flowing medium, comprising the steps of feeding the threads to be crimped, together with the medium, into a stuffing chamber of a crimping portion of a housing for the threads to be longitudinally compressed therein to produce crimping of such threads and for the medium to escape from the stuffing chamber through openings provided in the crimping portion; and introducing a gas stream into the stuffing chamber in a direction differing from the direction of advancement of the threads through the stuffing chamber as a single gas stream which enters the stuffing chamber directly sideways substantially transversely to the stuffing chamber to achieve a retardation of the threads during their passage through the stuffing chamber only at the commencement of the crimping operation, said crimping portion including a plurality of lamellae extending in the advancement direction and arranged in a radiating pattern to jointly bound the stuffing chamber, said introducing including blowing the gas stream between said lamellae as said single gas stream; selectively switching the gas stream on at the commencement of the crimping operation and off after damming of the threads has been initiated in the stuffing chamber; supplying the threads to the housing; and supplying the heated flowing medium to the housing.

2. A method of operating a texturizing nozzle for texturizing continuous filament threads by means of a heated flowing medium as defined in claim 1, wherein said introducing including blowing the gas stream at an obtuse angle to the direction of advancement of the threads, as considered in the direction of advancement of the threads.

3. A method of operating a texturizing nozzle for texturizing continuous filament threads by means of a heated flowing medium as defined in claim 1, wherein said introducing includes aiming the gas stream between two of said lamellae

* * * * *